United States Patent [19]

Mori et al.

[11] Patent Number: 4,749,905

[45] Date of Patent: Jun. 7, 1988

[54] HIGH PRESSURE DISCHARGE LAMP

[75] Inventors: Yasuki Mori, Yokohama; Masakazu Shibuya; Yoshiyuki Tokuda, both of Yokosuka, all of Japan

[73] Assignee: Kabushiki Kaisha Toshiba, Kawasaki, Japan

[21] Appl. No.: 930,416

[22] Filed: Nov. 14, 1986

[30] Foreign Application Priority Data

Nov. 15, 1985 [JP] Japan ..... 60-254942
Jan. 23, 1986 [JP] Japan ..... 61-11008

[51] Int. Cl.[4] ..... H01J 61/06; H01J 61/36

[52] U.S. Cl. ..... 313/623; 313/331; 313/632

[58] Field of Search ..... 313/623, 626, 631, 632, 313/331, 333

[56] References Cited

U.S. PATENT DOCUMENTS 3,633,061 1/1972 Paquette ..... 313/623 X
4,303,848 12/1981 Shimizu et al. ..... 313/346 R

FOREIGN PATENT DOCUMENTS 4912983 3/1974 Japan .
52125379 9/1977 Japan .

*Primary Examiner*—David K. Moore
*Assistant Examiner*—Sandra L. O'Shea
*Attorney, Agent, or Firm*—Oblon, Fisher, Spivak, McClelland & Maier

[57] ABSTRACT

A high pressure discharge lamp includes a glass enclosure defining a hermetically sealed discharge space filled with an ionizable gas. A pair of electrodes extend into the discharge space, each electrode having a connection end and a discharge end, between which electrodes, in the operating condition of the lamp, a discharge takes place. A pair of holding portions on opposite sides of the glass enclosure and hold the respective connection ends of the electrodes. Metal lead foils connected to the connection ends are sealed in the holding portions. One or both of the connection ends is shaped, e.g., as a conical frustrum or as a wedge, such that the thickness of its inner end is reduced with respect to the thickness of its outward end. The joining portion of the glass enclosure is internally necked at a position adjacent the reduced thickness portion of the connection end.

17 Claims, 1 Drawing Sheet

HIGH PRESSURE DISCHARGE LAMP

BACKGROUND OF THE INVENTION

1. Field of the Invention

The present invention relates to a high pressure discharge lamp and, more particularly, to improvements in an electrode used in a high pressure discharge lamp.

2. Description of the Prior Art

High pressure discharge lamps, for example mercury lamps, xenon lamps, and the like, typically include pair of elengated electrodes consisted consisting of very high melting point metal such as tungsten. Each electrode of a pair has a discharge end extending in a discharge space defined by a hermetically sealed enclosure made of hard glass such as quartz glass or bolosilicate glass and facing the other electrode. The electrodes also have connection ends embedded in holding portions of the glass enclosure extending outward therefrom. The connection ends of the electrodes are electrically led out the glass enclosure through metal lead foils consisting of high melting point metal such as molybdenum.

The discharge ends of the electrodes are made thick to ensure heat resistance. In particular, the discharge ends of the pair of electrodes of AC (alternating current) type high pressure discharge lamps, and one electrodes of DC (direct current) type high pressure discharge lamps, are made extremely thick. In the DC type discharge lamps, the pair of electrodes form respectively cathodes and anodes, as is well understood in the art. For simplicity, the anodes and the pair of electrodes are referred hereinafter simply as electrode. On the other hand, the connection ends of the electrodes have been restricted in size in their transverse direction. This is done in order to thicken the holding portions of the glass enclosure so that their pressure resistance is increased, according to the size restriction of the connection ends. Thus, the connection ends of the electrodes are reduced in diameter relative to the discharge ends, or flattened to a plate shape with reduced thickness.

The metal lead foils must be increased in size to increase their current-carrying capacity. However, the thickness of the metal lead foils is restricted to about 20 μm or at most 35 μm for reliable bonding to the quartz glass or the like by heat-welding.

In conventional high pressure discharge lamps, the diameter or thickness of the connection ends has been uniform along their elongated direction over their whole length. When high pressure discharge lamps are repeatedly switched on, the connection ends of the electrodes and the metal lead foils repeatedly thermally expand to a considerable extent. As a result, the metal lead foils are easily damaged by the repeated thermal expansion.

Further, the connection ends have tended to become loose in the holding portions as a result of repeated thermal expansion, so that the electrodes are no longer securely held in the glass enclosure.

In addition, the connection ends of the electrodes are repeatedly pressed against the holding portions of the glass enclosure by the thermal expansion. Particularly in the case of flattened connection ends, the corners of the connection ends along the elongated direction exert great pressure on the holding portions. If the thickness of the flattened connection ends is small, the pressures against the holding portions are concentrated on a small region. As a result the holding portions of the glass enclosure are easily damaged or cracked by accumulation of stresses due to the excessive stress concentration.

SUMMARY OF THE INVENTION

An object of the present invention to provide a high pressure discharge lamp in which a metal lead foil is not easily damaged.

Another object of the present invention is to provide a high pressure discharge lamp in which a sealed end of a glass enclosure is not easily cracked.

A further object of the present invention is to provide a high pressure discharge lamp in which an electrode is held in its proper position.

In order to achieve the above objects the connection ends of at least one electrode of a high pressure discharge lamp is made thicker at its outward end than at its inward end.

Thus the present invention provides a high pressure discharge lamp including: a glass enclosure defining a hermetically sealed discharge space, the enclosure being filled with an ionizable gass; a pair of electrodes extending into the discharge space, each electrode having a connection end and a discharge end, between which electrodes, in the operating condition of the lamp, a discharge takes place; a pair of holding portions provided on opposite sides of the glass enclosure, the holding portions holding the respective connection ends of the electrodes; and metal lead foils connected to the connection ends, the metal lead foils being sealed in the holding portions, wherein at least one of the connection ends is shaped such that the thickness of its outward end is larger than the thickness of its inward end.

The connection ends of both electrodes may be tapered such that the outward end is thicker than the inward end.

The invention includes embodiments in which at least one connection end is frustroconical or wedge-shaped.

BRIEF DESCRIPTION OF DRAWINGS

The present invention will now be described in detail with reference to the accompanying drawings, in which.

DETAILED DESCRIPTION OF THE PREFERRED EMBODIMENTS

Figure 3:
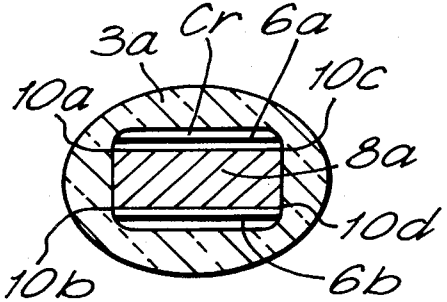
FIG. 3 is a cross-sectional view along the line A—A' in FIG. 2 showing another embodiment of the present invention.

The present invention will be described in detail with reference to the accompanying drawings, i.e., FIGS. 1, 2 and 3. Throughout the drawings, like reference numerals and letters are used to designate like or equivalent elements for the sake of simplicity of explanation.

Figure 1:
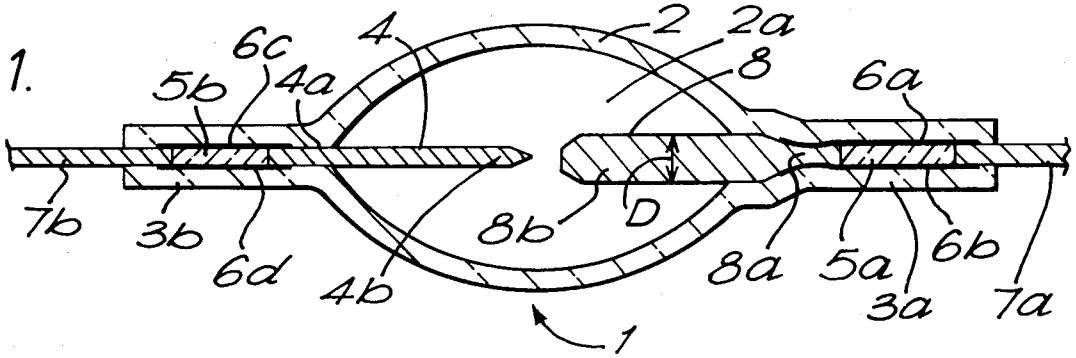
FIG. 1 is a cross-sectional view showing one embodiment of a high pressure discharge lamp according to the present invention.

FIG. 1 shows a first embodiment of a high pressure discharge lamp, such as a xenon lamp of about 500W rating, according to the present invention. The high pressure discharge lamp 1 has a transparent glass enclosure 2 made of hard glass, such as quartz glass and borosilicate glass, to define generally an oval discharge space 2*a* and cylindrical end portions 3*a* and 3*b* at opposite sides of the discharge space 2*a*. Extending concentrically within the end portions 3*a* and 3*b* and into the discharge space 2a are two electrodes, an anode 8 and a cathode 4. The anode 8 and cathode 4 are held at their outer ends, i.e., the connection ends 8a and 4a, in the cylindrical holding portions 3a and 3b, respectively. The anode 8 is shaped at its inner end, i.e., anode end 8b, as a rod with a diameter D of about 6 mm and is tapered at its connection end 8a as described later. The cathode 4 is shaped as a rod with a diameter of about 3 mm over its whole length from the connection end 4a to its inner end, i.e, cathode end 4b. The connection ends 8a, 4a are electrically connected to outer lead conductors 7a and 7b through metal lead foils, respectively. Each of the metal lead foils is made up of a plurality of pieces, for example, two pieces 6a, 6b and 6c, 6d. Each of the metal lead foils 6a, 6b, 6c and 6d has a slender leaf-like cross-section with a width of about 5 mm and a maximum thickness of about 26 μm at the center. The metal lead foils 6a, 6b or 6c, 6d of each pair are held apart from each other by a glass separator rod 5a or 5b, respectively. The glass separator rod 5a and 5b are made of the same material as the glass enclosure 2, e.g., quartz glass. The metal lead foils 6a, 6b or 6c, 6d are soldered to the connection ends 8a, 4a and the outer lead conductors 7a, 7b, respectively e.g. with platinum solder, respectively. The glass separator rods 5a and 5b are placed between the electrodes 8, 4 and the outer lead conductors 7a, 7b, respectively.

Figure 2:
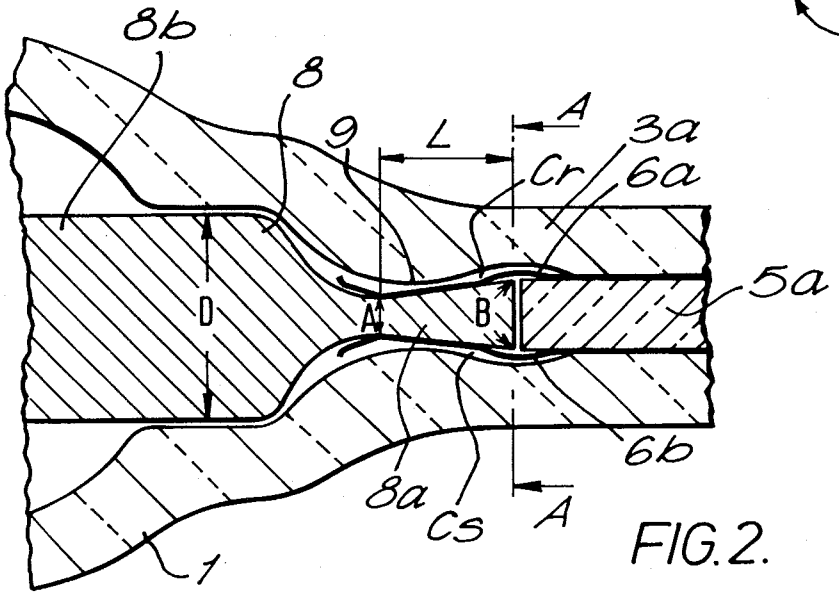
FIG. 2 is an enlarged cross-sectional view showing the region around the connection end of an electrode of the high pressure discharge lamp shown in FIG. 1.

Referring now to FIG. 2, which shows a part the high pressure discharge lamp 1 around the connection end 8a of the anode 8, the construction of this part will now be described. As indicated above, the connection end 8a of the anode 8 is tapered. In the embodiment shown in FIG. 2, the tapered connection end 8a is formed as a section of a cone, with a length L of about 7.0 mm and diameters A and B of about 2.0 mm and 2.5 mm on its inward and outward ends. The metal lead foils 6a and 6b are soldered at their inward ends to the tapered surface of the tapered connection end 8a with platinum solder as described above. The cylindrical end portion 3a of the glass enclosure 2 is fused to the metal lead foils 6a and 6b at a position adjacent the glass separator rod 5a. The cylindrical holding portion 3a is also welded to the glass separator rod 5a where the metal lead foils 6a and 6b are separated, so that the discharge space 2a is hermetically sealed there. The internal diameter of the cylindrical holding portion 3a is increased over part of its length so that a relatively large clearance Cr is left around a portion where the connection end 8a and the glass separator rod 5a are adjacent to each other. The inner wall of the cylindrical holding portion 3a is then reduced in diameter toward the interior of the glass enclosure 2, so that a very small clearance Cs is left between the inner wall and tapered connection end 8a. The inner wall of the cylindrical holding portion 3a is again enlarged in diameter inwardly along the shape of the anode 8, after being necked at a portion 9 where the wall faces the innermost end of the tapered connection end 8a. The metal lead foils 6a and 6b are curved in the large clearance Cr to remove a stress caused by the thermal expansion.

The anode 8 is heated to a very high temperature when the lamp is operated. Hence the connection end 8a tends to expand thermally in both the longitudinal and the traverse directions. Longitudinal expansion of the connection end 8a takes place only in inward direction, since movement of the outward end of the connection end 8a is restricted by the glass separator rod 5a. The tapered connection end 8a thus meets with at least the necked portion 9 of the inner wall of the cylindrical holding portion 3a, so that the tapered connection end 8a is restrained from excessive thermal expansion. As a result, excessive stretching of the metal lead foil 6a and 6b by the thermal expansion of the connection end is avoided. Accordingly damage to the metal lead foil 6a and 6b due to repeated thermal expansion is prevented. Morever the connection end 8a is pressed against the inner wall of the cylindrical holding portion 3a of the glass enclosure 3 by the thermal expansion during the operation of the discharge lamp 1. Consequently the anode 8 is firmly held at its connection end 8a in the cylindrical holding portion 3a of the glass enclosure 3.

Lamps constructed as described above were compared to practical tests with conventional discharge lamps. In these tests, five samples each of a conventional discharge lamp and of the lamp according to the present invention, of the same power rating, were used. In the conventional discharge lamp samples, each of the connection ends was formed as a straight rod with a diameter of 2.0 mm and a length of 7.0 mm. In the discharge lamp samples according to the present invention, each of the connection ends 6a, 8a was shaped as a conical frustrum with the diameters A, B of 2.0 mm and 2.5 mm respectively and the length L of 7.0 mm. Each lamp was alternately turned on and off for periods of five minutes.

It was found that the first conventional lamp sample was damaged after about 1,200 on-off operations, the second after about 1,500 on-off operations, and the third after 2,200 on-off operations. The remaining two conventional lamp samples were not broken after about 3,000 on-off operations, but some harmful changes were observed. On the other hand, no harmful changes were observed in any of the samples of the discharge lamps according to the present invention after about 3,000 turn-off operations.

The effect of variation of the gradient G of the taper of the conical frustrum of the connection end 8a was next examined. The gradient G is defined as:

$$G=(B/2-A/2)/L=(B-A)/2L$$

In a series of experiments, it was observed that when the gradient G exceeded 1/5 the cylindrical holding portion 3a tended to suffer damage such as cracks, since the forces exerted on the cylindrical holding portion 3a due to the expansion of the connection end 8a becomes too large, and concentrated on a small area of the inner wall. It was also observed that when the gradient G was less than 1/50 the connection end 8a expanded freely in the cylindrical end portion 3a against the relatively weak restriction by the inner wall of the cylindrical holding portion 3a, and the metal lead foils 6a and 6b tended to be broken. Advantageously, therefore, the gradient G should have a value within the range of about 1/5 to 1/50.

A second embodiment of the high pressure discharge lamp according to the present invention will now be described in detail with reference to FIG. 3 of the drawings. Except of the shape of the connection end 8a of the electrode 8 the construction of this embodiment is quite similar to that of the first embodiment, so that reference is also made to FIGS. 1 and 2 for the remaining features.

In the second embodiment the connection end 8a of the electrode 8 is shaped as a part of wedge. The other parts are the same as in the first embidiment. The wedge-shaped connection end 8a has a length L of about 7.0 mm and thicknesses A and B at its inward and outward ends of about 2.2 and 2.7 mm respectively (see FIG. 2). Metal lead foils 6a and 6b are soldered at their inward ends to both the surfaces forming the wedge shape.

A second series of comparative tests was performed using the second embodiment. These tests were again performed on five samples each of a conventional discharge lamp and of a lamp according to the present invention, of the same power rating. In the conventional discharge lamp samples, each of the connection ends was shaped as a part of wedge with thicknesses A, B of 2.2 and 2.7 mm respectively and the length of 7.0 mm. Each lamp was alternately turned on and off for periods of five minutes each.

In these tests it was again found that the first conventional lamp sample was damaged after about 1,200 on-off operations, the second after about 1,500 on-off operations, and the third after 2,200 on-off operations. The remaining two conventional lamp samples were not broken after about 3,000 on-off operations, but some harmful changes were observed. On the other hand, no harmful changes wre observed in any of the samples of the discharge lamp according to the present invention after about 3,000 turn-off operations.

Next, the effect of variation of the gradient (defined as before) G of the wedge shape of the connection end 8a was next examined. It was again observed that the cylindrical holding portion 3a tended to suffer damage such as crackings when the gradient G exceeded 1/5, and that the metal lead foils 6a and 6b tended to be broken when the gradient G was less than 1/50, both for the same reasons as in the case of the first embodiment. Again, therefore, the gradient G advantegeously has a value within the range of about 1/5 to 1/50.

In further tests, the effect of varying the ratio R of the thickness B of the wedge-shaped connection end 8a at its outward end to the diameter D of the discharge end 8b of the electrode 8 was examined. This ratio R, i.e., a size reduction ratio, is defined by B/D.

It was also observed in the tests that when the size reduction ratio R was less than about 0.35, at an internal gas pressure of over 10 atmospheres the holding of the electrode 8 was excessively weakened. In addition the resistance to pressure of the cylindrical holding portion 3a of the glass enclosure 3 was reduced. It will be seen from FIG. 3 that the connection end 8a in this embodiment has at its outward end a flat rectangular cross-section with four edges 10a, 10b, 10c and 10d. When the thickness B of the connection end 8a at its outward end becomes too small, the pressures exerted by the respective pairs of edges 10a and 10b, 10c and 10d as a result of thermal expansion are concentrated in a very narrow region of the cylindrical holding portion 3a. Hence the cylindrical holding portion 3a can easily be cracked by an excessive accumulation of stresses arising from the repeatedly applied forces. In particular, the cylindrical holding portion 3a is more easily cracked when the internal gas pressure of the discharge space 2a is too high.

On the other hand, it is also observed that when the size reduction ratio R exceeds about 0.55, the cylindrical holding portion 3a is also easily cracked. This is because the thickness of the cylindrical holding portion 3a is excessively reduced as the thickness B of the connection end 8a increases. Also, in a discharge lamp in which the metal lead foils 6a and 6b are sealed in the glass body of the cylindrical holding portion 3a without the use of a glass separator rod, the metal lead foils 6a and 6b are bent at the outward end of the connection end 8a. Therefore, when the thickness B of the connection end 8a is too large, the bending angle of the metal lead foils 6a and 6b becomes excessively sharp. This also causes the metal lead foils 6a and 6b to be broken.

The result of the above experiments showed that a size reduction ratio R (=B/D) within the range of about 0.35 to about 0.55 (i.e., such that $0.35<R<0.55$) is favourable for a high pressure discharge lamp with a wedge-shaped connection end. In a sample with the dimensions D and B about 6.0 mm and 2.7 mm respectively (i.e. R (=B/D)=0.45) and an internal gas pressure of 40 atmospheres, no change was observed in the cylindrical holding portion 3a after about 3,000 on-off operations.

Various modifications and variations may be made in the invention within the scope of the claims. For example, the present invention may be applied to the connection end 4a of the cathode 4 (see FIG. 1). Further, the present invention can be applied to an AC type high pressure discharge lamp. The electrodes according to the present invention are particularly useful for reducing damage to the metal lead foils in high intensity discharge lamps.

What is claimed is:

1. A high pressure discharge lamp comprising:

a glass enclosure defining a hermetically sealed discharge space, the enclosure being filled with an ionizable gas;

a pair of electrodes extending into the discharge space, each electrode having a connection end and a discharge end, between which electrodes, in the operating condition of the lamp, a discharge takes place;

a pair of holding portions provided on opposite sides of the glass enclosure, the holding portions holding the respective connection ends of the electrodes;

a pair of outer lead conductors, a part of the respective conductor being sealed in an outer end of the holding portion; and metal lead foils connected between the connection ends and the outer lead conductors, the metal lead foils being sealed in the holding portions, wherein at least one of the connection ends is shaped such that the thickness of its inner end nearest the discharge space is reduced with respect to he thickness of its outward end away from the discharge space, and the holding portion of the glass enclosure is internally necked at a position adjacent the reduced thickness portion of the connection end.

2. A high pressure discharge lamp of claim 1, wherein at least one connection end is shaped as a conical frustrum.

3. A high pressure discharge lamp of claim 2, wherein the gradient of the connection end shaped into the conical frustrum, from the outward end to the inner end, is within the range of about 1/5 to about 1/50.

4. A high pressure discharge lamp of claim 1, wherein a space is provided within the holding portions adjacent the outward end of the connection end, into which space the metal lead foils can expand outwardly upon heating during operation of the lamp.

5. A high pressure discharge lamp of claim 4, wherein at least one connection end is shaped as a conical frustrum.

6. A high pressure discharge lamp of claim 5, wherein the gradient of the wedge-shaped connection end, from the outward end to the inner end, is within the range of about 1/5 to about 1/50.

7. A high pressure discharge lamp of claim 1, wherein at least one connection end is wedge-shaped.

8. A high pressure discharge lamp of claim 7, wherein the gradient of the outer surface of the wedge-shaped connection end, from the outward end to the inner end, is within the range of about 1/5 to about 1/50.

9. A high pressure discharge lamp of claim 7, wherein the thickness of the outward end of the each wedge-shaped connection end is less than the diameter of the discharge end.

10. A high pressure discharge lamp of claim 9, wherein the size reduction ratio is within the range of about 0.35 to about 0.55.

11. A high pressure discharge lamp of claim 10, wherein the gradient of the wedge-shaped connection end, from the outward end to the inward end, is within the range of about 1/5 to about 1/50.

12. A high pressure discharge lamp of claim 7, wherein a space is provided within the holding portions adjacent the outward end of the connection end, into which space the metal lead foils can expand outwardly upon heating during operation of the lamp.

13. A high pressure discharge lamp of claim 12, wherein the gradient of the wedge-shaped connection end, from the outward end to the inner end, is within the range of about 1/5 to about 1/50.

14. A high pressure discharge lamp of claim 12, wherein the thickness of the outward end of the each wedge-shaped connection end is less than the diameter of the discharge end.

15. A high pressure discharge lamp of claim 14, wherein the size reduction ratio is within the range of about 0.35 to about 0.55.

16. A high pressure discharge lamp of claim 15, wherein the gradient of the wedge-shaped connection end, from the outward end to the inner end, is within the range of about 1/5 to about 1/50.

17. A high pressure discharge lamp comprising:

a glass enclosure defining a hermetically sealed discharge space, the enclosure being filled with an ionizable gas;

a pair of electrodes extending into the discharge space, each electrode having a connection end and a discharge end, between which electrodes, in the operating condition of the lamp, a discharge takes place;

a pair of holding portions provided on opposite sides of the glass enclosure, the holding portions holding the respective connection ends of the electrodes;

a pair of outer lead conductors, a part of the respective conductor being sealed in an outer end of the holding portion;

glass seaprator rod sealed in the respective holding portion between the connection end and the outer lead conductor and metal lead foils connected between the connection ends and the outer lead conductors, the metal lead foils being sealed in the holding portions, said glass separator rod being sealed to the metal lead foils wherein at least one of the connection ends is shaped such that the thickness of its inner end nearest the discharge space is reduced with respect to the thickness of its outward end away from the discharge space, and the holding portion of the glass enclosure is internally necked at a position adjacent the reduced thickness portion of the connection end.

* * * * *